US007034766B2

(12) United States Patent
Kirino et al.

(10) Patent No.: US 7,034,766 B2
(45) Date of Patent: Apr. 25, 2006

(54) BROADCAST RECEIVING ANTENNA AND TELEVISION BROADCAST RECEIVER

(75) Inventors: Hideki Kirino, Ayauta-gun (JP); Kunio Ninomiya, Niihama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/930,831

(22) Filed: Sep. 1, 2004

(65) Prior Publication Data

US 2005/0168390 A1 Aug. 4, 2005

(30) Foreign Application Priority Data

Sep. 5, 2003 (JP) ..... 2003-314655
Jun. 10, 2004 (JP) ..... 2004-172995

(51) Int. Cl.
*H01Q 13/00* (2006.01)

(52) U.S. Cl. ..... 343/772; 343/776
(58) Field of Classification Search ..... 343/762, 343/772, 776
See application file for complete search history.

(56) References Cited

U.S. PATENT DOCUMENTS

| | | | | |
|---|---|---|---|---|
| 6,111,547 | A * | 8/2000 | Gau et al. | 343/786 |
| 6,115,002 | A * | 9/2000 | Fischer et al. | 343/770 |
| 6,271,799 | B1 * | 8/2001 | Rief et al. | 343/776 |
| 6,388,635 | B1 * | 5/2002 | Nilsson | 343/786 |
| 6,714,166 | B1 * | 3/2004 | Sasaki et al. | 343/785 |

FOREIGN PATENT DOCUMENTS

| | | |
|---|---|---|
| JP | 58-15303 | 1/1983 |
| JP | 5-80014 | 10/1993 |
| JP | 2003-124738 | 4/2003 |

* cited by examiner

*Primary Examiner*—Shih-Chao Chen
(74) *Attorney, Agent, or Firm*—Wenderoth, Lind & Ponack, L.L.P.

(57) ABSTRACT

A slim television broadcast receiver employing antennas in which a waveguide is formed by a metallic plate and a copper foil on a printed circuit board. An insulating magnetic element is loaded so as to block one of a pair of aperture planes of the waveguide, and the aperture area is enlarged by beveling the other aperture plane. Tuning elements are provided on opposed sides with respect to the center part of the other aperture, which antennas are placed on opposed side ends of the slim television broadcast receiver, thereby performing electronic tuning and phase synthesis diversity reception.

9 Claims, 7 Drawing Sheets

BROADCAST RECEIVING ANTENNA AND TELEVISION BROADCAST RECEIVER

FIELD OF THE INVENTION

The present invention relates to broadcast receiving antennas and television broadcast receivers and, more particularly, to digital television broadcast receiving antennas and digital television broadcast receivers for receiving digital television broadcasts indoors in free locations.

BACKGROUND OF THE INVENTION

Conventionally, in analog television broadcasting, in a case of receiving broadcast waves in a weak electric field, reduction in a receiving level by several dB greatly degrades the quality of pictures, or in a case of receiving broadcast waves in an urban area, unpleasant ghost pictures are generated due to waves which are reflected from buildings. Therefore, an antenna which has a high gain in a direction of incoming radio waves and a low gain in a direction of reflected radio waves must be placed in a location where the incoming radio waves are as strong as possible. Thus, as a conventional antenna mount method, there has exclusively been adopted a method of supporting an antenna that has a directivity in the horizontal direction using a metallic pole, to mount the same in a high position on the roof.

On the transmitting end that transmits broadcast waves of the analog television broadcasting, horizontal polarization has been adopted as polarization of the broadcast waves. This is because the reduction in the receiving level resulting from a disturbance of the received electric field caused by a current that is induced on the metallic pole of the antenna becomes smaller when the antenna (receiving end) receives the horizontally polarized waves, and further, on the transmitting end, a transmission antenna that has the horizontal polarization and no directivity in the horizontal direction is realized.

Conventionally, a current inducing type dipole antenna has been exclusively employed as the antenna on the receiving end of the analog television broadcast waves because it has a small resistance to winds, has a large equivalent receiving area, i.e., has a wide receiving band, and further can increase the gain by easily increasing the number of elements.

It is also possible to receive the broadcast waves of the analog television broadcasting not using the above-mentioned outdoor antenna but using an indoor antenna which does not need an antenna line from the wall to the receiver. Also as such indoor antenna, a current inducing type dipole antenna has been conventionally employed exclusively, because it has a wide receiving band, and it can be realized in a simple structure and at low cost (for example, refer to Laid-open Japanese utility model publication No. Hei. 05-80014 (p. 2, FIG. 1)).

On the other hand, in digital television broadcasting which has recently become popular, when broadcast waves of a relatively strong electric field are received in an urban area, no ghost picture occur in principle even when there are reflected waves from the buildings, in contrast to the analog television broadcasting. Therefore, attention is being given to the usability of the above-mentioned indoor antenna which does not need an antenna line from the wall, as an antenna for receiving broadcast waves of the digital television broadcasting.

Also on the user side, there is a demand that broadcast waves of the digital television broadcasting are received using an indoor antenna also in the case of receiving broadcast waves in a weak electric field, and its realization has been expected more than in the analog television broadcasting, because it has previously been widely known that the digital television broadcasting has a feature that the picture quality is not deteriorated unless the receiving level of the radio waves becomes lower than a threshold value. Further it has an advantage of freely placing a receiver indoor when using the above-mentioned indoor antenna.

When supposing that the digital television broadcast receiving antenna is realized by an indoor antenna, an antenna which has a directivity in a specific direction and can change the directivity to a direction of incoming radio waves by an electronic control is demanded, because the digital television broadcast receiving indoor antenna has also a physical merit of not wasting the gain.

Further, since it is considered that broadcasting of the digital television broadcasts with horizontal polarization is suited for receiving the radio waves even by an analog television broadcast receiving antenna which has already become widely available, an antenna that can receive horizontally polarized waves is suitable for the digital television broadcast receiving indoor antenna.

In light of the foregoing, an antenna utilizing a magnetic current that is induced at an aperture which is provided on a metallic plate or a metallic box, as a radiation source (hereinafter, referred to as a magnetic current inducing type antenna) can be placed in a smaller area than a current inducing type antenna that has conventionally been used as the indoor antenna because this antenna can receive the horizontally polarized waves in a vertically long slender shape. Furthermore, there is no need of orienting the antenna toward a direction of incoming radio waves because it has almost no horizontal directivity. When noticing these characteristics, this magnetic current inducing type antenna is promising as a unit antenna element for the digital television broadcast receiving indoor antenna which can respond the need for the above-mentioned digital television broadcast receiving antenna. (For example, refer to Japanese Published Patent Application No. Sho. 58-15303 (p. 7, FIG. 8) and Japanese Published Patent Application No. 2003-124738 (p. 6, FIGS. 1–3)).

As described above, the magnetic current inducing type antenna that is considered as promising as a digital television broadcast receiving antenna is considered as suitable for the digital television broadcast receiving antenna, but a digital television broadcast receiving antenna employing such magnetic current inducing type antenna has not been realized yet.

The main reason is that, like the current inducing type dipole antenna, the unit antenna element of the magnetic current inducing type has a high Q value indicating the strength of the resonance, and cannot receive broadcast waves in a wide band that is expected in the digital television broadcasting, for example broadcast waves over a wide band extending from 470 MHz to 710 MHz in Japan.

That is, in order to receive the broadcast waves over a wide range extending from 470 MHz to 710 MHz or the like, there is no choice of either combining plural unit antenna elements having different resonance frequencies, or lowering a Q value of a unit antenna element and electronically tuning the unit antenna element for the broadcast waves. However, in the former case, the antenna becomes larger than the current inducing type dipole antenna and is not practical to use, while in the latter case, a reactance changing range that is required by a tuning element which is provided in the unit antenna element becomes large and it is difficult to realize.

Further, as for a digital television broadcast receiver, there has been no measure for realizing a receiver which can orient the antenna directivity toward a direction of incoming broadcast waves by an electronic control, and in which there is no antenna part jutting while an antenna is mounted or integrated therein.

SUMMARY OF THE INVENTION

The present invention relates to a low-cost broadcast receiving antenna employing a magnetic current inducing type unit antenna element, which can be mounted or integrated in a slim television broadcast receiver without greatly impairing the feature (the slimness). Furthermore, the antenna unit can be tuned for broadcast waves over a wide band that is expected in the digital television broadcasting, for example broadcast waves extending from 470 MHz to 710 MHz in Japan. The invention also relates to a television broadcast receiver in which the antenna can be installed or integrated without the antenna jutting, as well as orient the antenna directivity toward a direction of the incoming of broadcast waves by electronic control.

Other objects and advantages of the invention will become apparent from the detailed description that follows. The detailed description and specific embodiments described are provided only for illustration since various additions and modifications within the spirit and scope of the invention will be apparent to those of skill in the art from the detailed description.

According to a 1st aspect of the present invention, there is provided a broadcast receiving antenna of a magnetic-current inducing type comprising: a waveguide having a pair of aperture planes, which are formed by a metallic plate and a copper foil on a printed circuit board; an insulating magnetic element which is loaded in the waveguide so as to block one of the pair of aperture planes of the waveguide; and tuning elements for changing a resonance frequency of the waveguide, which are placed on opposed sides with respect to a center part of the other aperture plane of the waveguide.

According to a 2nd aspect of the present invention, in the broadcast receiving antenna of the 1st aspect, the insulating magnetic element has an anisotropic permittivity which is smaller in a direction perpendicular to the printed circuit board than in a direction parallel to the printed circuit board.

According to a 3rd aspect of the present invention, in the broadcast receiving antenna of the 2nd aspect, the insulating magnetic element is formed by laminating layers of a magnetic material and a dielectric material which has a permittivity that is smaller than that of the magnetic material.

According to these aspects, it is possible to realize a digital television broadcast receiving antenna which can be mounted or integrated in a slim television receiver without greatly impairing the slimness of the receiver, and can tune the frequency band of the digital television broadcast for an expected wide range, such as from 470 MHz to 710 MHz, at low cost.

According to a 4th aspect of the present invention, in the broadcast receiving antenna of the 1st aspect, the length of the waveguide is equal to or shorter than a quarter of an intra-tube wavelength.

According to this aspect, it is possible to realize a digital television broadcast receiving antenna which can be mounted or integrated in a slim television receiver without greatly impairing the slimness, and can tune the frequency band of the digital television broadcast for an expected wide range, such as from 470 MHz to 710 MHz, at lower cost.

According to a 5th aspect of the present invention, in the broadcast receiving antenna of the 1st aspect, the tuning elements which are placed on opposed sides with respect to the center part of the other aperture plane are respectively located at a position within a quarter of a wavelength of a used frequency from metallic side walls of the waveguide.

According to this aspect, even when a general-purpose tuning element is used as the tuning element in the waveguide as in the prior art, it is possible to realize a digital television broadcast receiving antenna which has a wider tuning frequency band than in the prior art.

According to a 6th aspect of the present invention, there is provided a slim television broadcast receiver for receiving television broadcasts, including one of a plasma display, a liquid crystal display, an electroluminescence display, and a field emission display, comprising: two electronically tunable aperture waveguide antennas which are integrated into or mounted on the receiver so that magnetic currents induced on aperture parts of the antennas are located on respective side ends of the receiver. These aperture waveguide antennas are used at a time of receiving, with being tuned for a receiving channel of the television broadcast.

According to this aspect, it is possible to realize a digital television broadcast receiver which can change an antenna directivity toward a direction of incoming broadcast waves by electronic control and in which an antenna is mounted or integrated without jutting the antenna part, whereby it is possible to realize a digital television broadcast receiver that enables to provide digital television broadcasts in a free position indoors, without requiring an external antenna or an externally jutting indoor antenna, which is connected via a cable, or an external device which receives the digital television broadcasts and relay or retransmit the broadcasts to the receiver.

According to a 7th aspect of the present invention, in the television broadcast receiver of the 6th aspect, the electronically tunable aperture waveguide antenna is a magnetic current inducing type antenna including: a waveguide having a pair of aperture planes, which are formed by a metallic plate and a copper foil on a printed circuit board; an insulating magnetic element which is loaded in the waveguide so as to block one of the pair of aperture planes of the waveguide; and tuning elements for changing a resonance frequency of the waveguide, and the tuning elements are placed on opposed sides with respect to a center part of the other aperture plane (i.e., second one of the pair of aperture planes) of the waveguide.

According to an 8th aspect of the present invention, in the television broadcast receiver of the 7th aspect, the insulating magnetic element has an anisotropic permittivity which is smaller in a direction perpendicular to the printed circuit board than in a direction parallel to the printed circuit board.

According to a 9th aspect of the present invention, in the television broadcast receiver of the 8th aspect, the insulating magnetic element is formed by laminating layers of a magnetic material and a dielectric material which has a smaller permittivity than that of the magnetic material.

According to these aspects, it is possible to realize a digital television broadcast receiver which does not have a jutting antenna part and does not greatly impair the slimness of the receiver even when an antenna is mounted or integrated in a slim television broadcast receiver, at low cost.

According to a 10th aspect of the present invention, in the television broadcast receiver of the 6th aspect, the two electronically tunable aperture waveguide antennas perform phase synthesis diversity reception.

Therefore, it is possible to realize a digital television broadcast receiver that can change the antenna directivity toward the direction of incoming broadcast waves by the electronic control, and can obtain a strong receiving signal.

DETAILED DESCRIPTION OF THE PREFERRED EMBODIMENTS

Hereinafter, embodiments of a broadcast receiving antenna and a television broadcast receiver according to the present invention will be described in detail with reference to the drawings.

Embodiment 1

A digital television broadcast receiving antenna according to a first embodiment will be described with reference to FIGS. 1 to 4.

Initially, a structure of the digital television broadcast receiving antenna according to the first embodiment will be described with reference to FIGS. 1 and 2.

Figure 1:
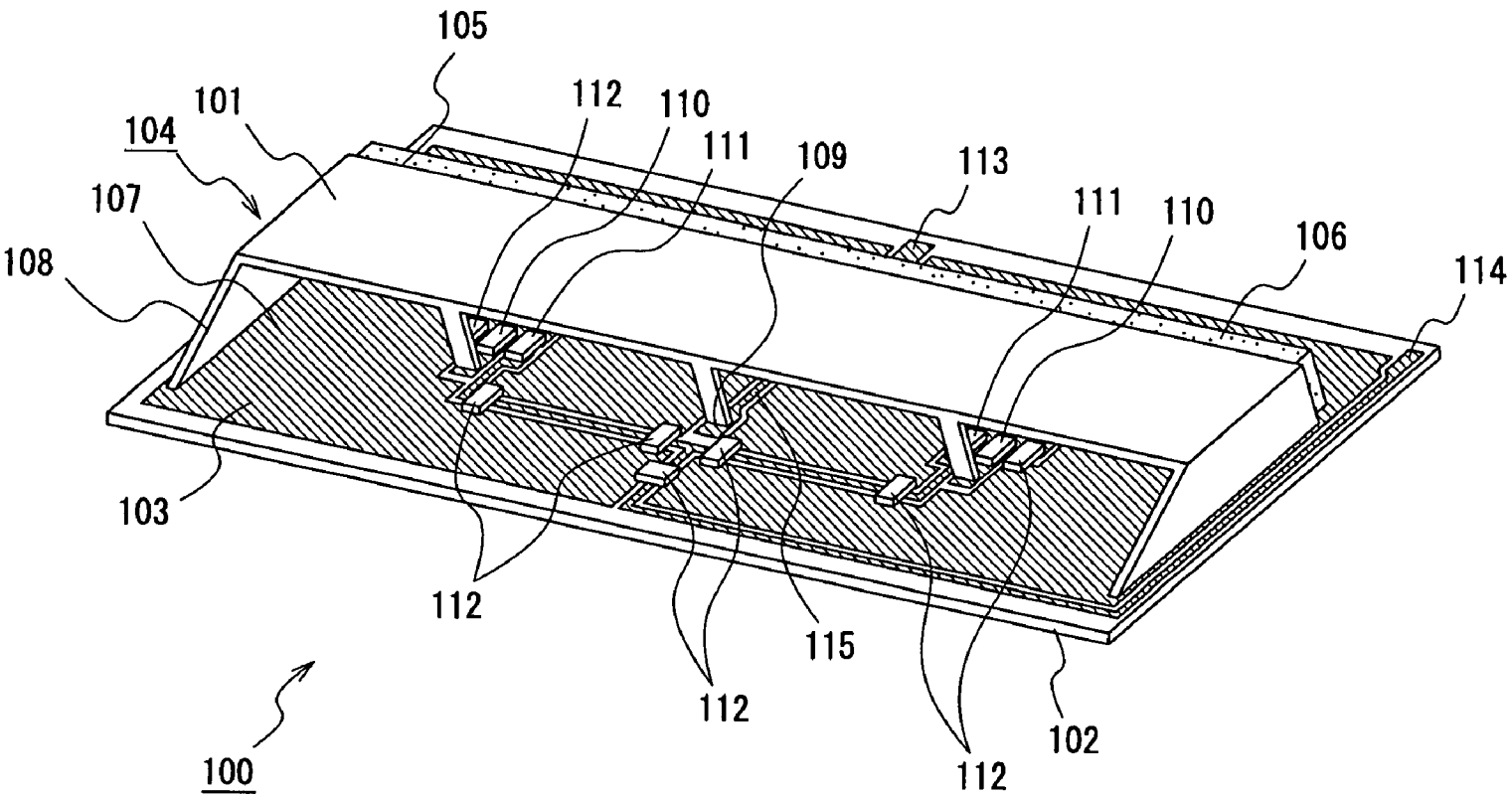
FIG. 1 is a diagram illustrating a digital television broadcast receiving antenna according to a first embodiment of the present invention.
Figure 2:
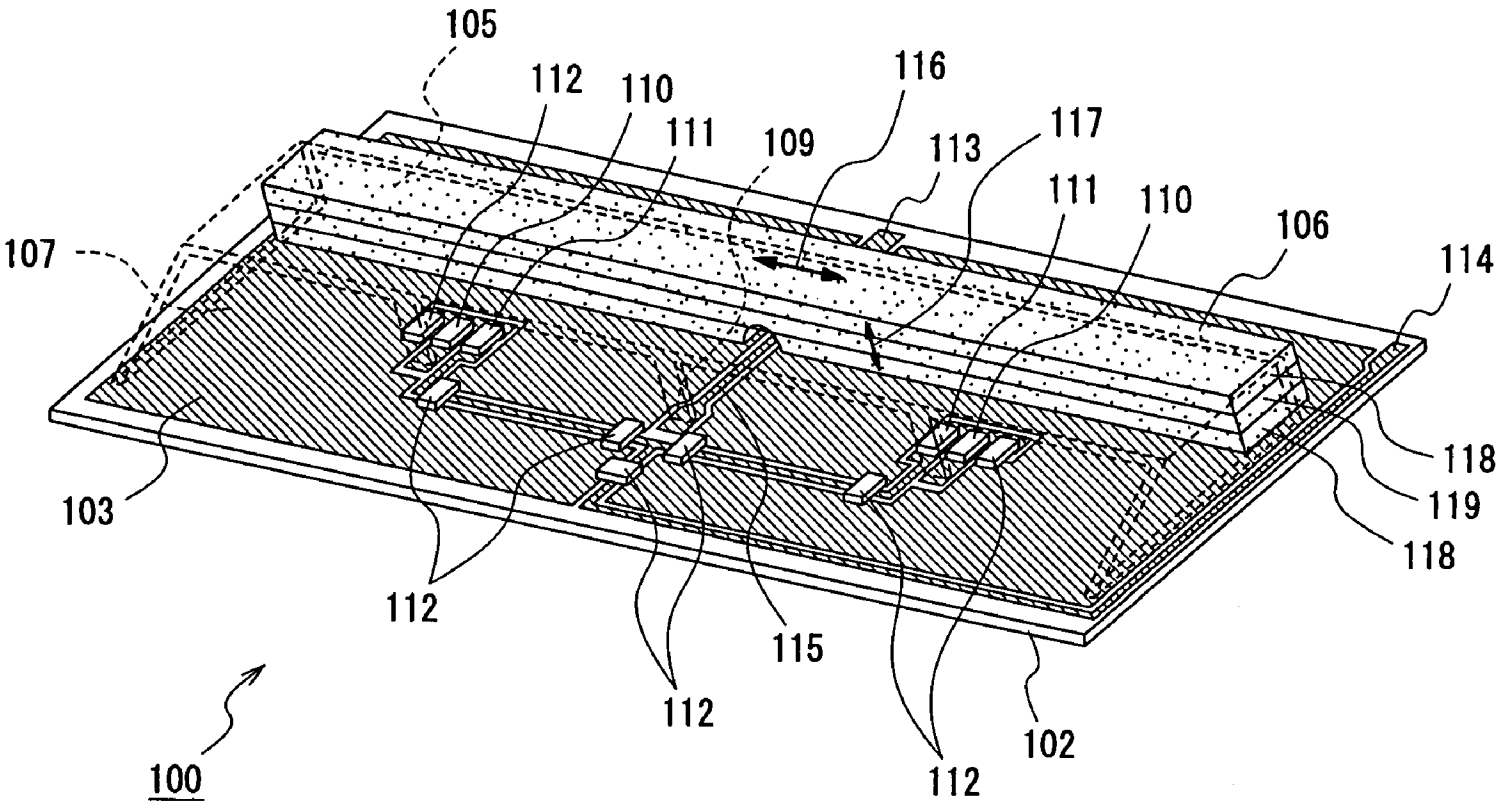
FIG. 2 is a diagram illustrating the digital television broadcast receiving antenna according to the first embodiment, from which a metallic plate of a waveguide is eliminated.

FIG. 1 is a diagram illustrating a structure of the digital television broadcast receiving antenna according to the first embodiment, and FIG. 2 is a diagram illustrating the structure of the digital television receiving antenna of FIG. 1 when a metallic plate is eliminated therefrom.

In FIG. 1, a digital television broadcast receiving antenna 100 includes a waveguide 104 that is formed by a metallic plate 101 and a copper foil 103 on a printed circuit board 102. A main aperture plane 107 is provided at the front of the waveguide 104, and a rear aperture plane 105 is provided at the back of the waveguide 104. A beveling 108 is performed to the main aperture plane 107, (i.e., the main aperture plane has a bevel) to enlarge the aperture area of the main aperture plane 107. As shown in FIG. 2, an insulating magnetic element 106 is loaded in the waveguide 104, to block the rear aperture 105 which is selected from the main aperture 107 and the rear aperture 105. In FIG. 2, reference numeral 116 denotes an arrow indicating a direction that is parallel to the surface of the printed circuit board, and numeral 117 denotes an arrow indicating a direction that is perpendicular to the surface of the printed circuit board.

A feeding point 109 is provided at the center part of the main aperture plane 107, and an electronic tuning element 110 for changing the resonance frequency of the waveguide 104 is provided on either side of the center part. The feeding point 109 has a structure of being connected to outside at a feeding terminal 113 via a feeding line 115. In this first embodiment, descriptions will be given of a case where a Varactor diode that has a capacity changing according to an applied voltage is employed as the electronic tuning element 110. Further, as shown in FIG. 1, in order to apply a tuning controlling voltage, a tuning control voltage terminal 114, RF choke coils 111, and RF bypass capacitors 112 are provided in the antenna 100 according to this first embodiment.

The aperture waveguide according to this invention is commonly utilized as an antenna by employing a magnetic current associated with an electric field that appears on the aperture plane of the waveguide as a radiation source. The width of the aperture of the waveguide is ½ wavelength or longer of the used frequency (Here, when the waveguide is filled with a dielectric material, the width is ½ of a reduced wavelength or longer), and the length of the waveguide is ¼ of an intra-wavelength when one of the apertures is short-circuited, while the waveguide length is ½ of the intra-wavelength when one of the apertures is opened, thereby achieving resonance.

When the cost of the aperture waveguide is to be lowered, the waveguide length is reduced as much as possible, thereby to reduce the amounts of components of the waveguide. However, when the length of the aperture waveguide is reduced to shorter than ¼ of the intra-wavelength, which is the minimum length required for the resonance, the radiation efficiency is greatly reduced because the waveguide cannot resonate in the tube axis direction, whereby this waveguide can no longer be practically used as an antenna.

Thus, in the digital television broadcast receiving antenna 100 according to the first embodiment, in order to further reduce the cost, the insulating magnetic element 106 is provided inside the waveguide 104 near the rear aperture plane 105 as described above, thereby enabling to practically use the waveguide 104 as an antenna even when the length of the waveguide 104 is made shorter than ¼ of the intra-wavelength.

Figure 3:
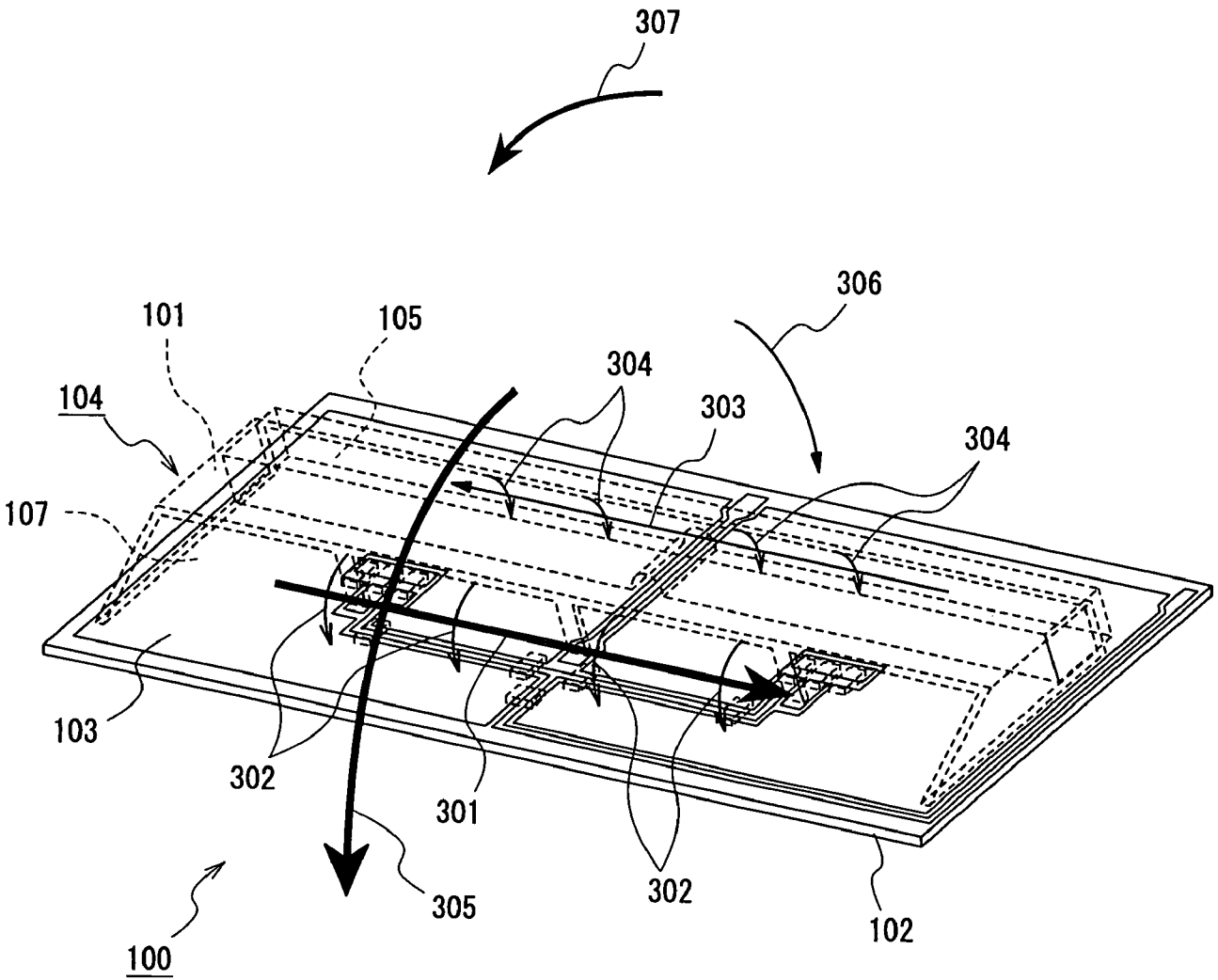
FIG. 3 is a diagram illustrating magnetic currents and electric fields which are generated in the digital television broadcast receiving antenna according to the first embodiment.

Hereinafter, the principle of the antenna 100 according to the first embodiment will be described in detail with reference to FIG. 3. As an antenna that is constituted by only components having no directivity, such as a gyrator (active function element), has the same operation principle and characteristics in transmitting and receiving radio waves, the description will be given of a case where the antenna 100 is used for transmitting radio waves as an example. FIG. 3 is a diagram showing electric fields and magnetic currents that appear on both aperture planes of the waveguide of the digital television broadcast receiving antenna according to the first embodiment, and the states of the electric fields that are radiated from the magnetic currents. Numeral 301 denotes a magnetic current that appears on the main aperture plane, numeral 302 denotes an intra-tube electric field that appears on the main aperture plane, numeral 303 denotes a magnetic current that appears the rear aperture plane, numeral 304 denotes an intra-tube electric field that appears on the rear aperture plane, numeral 305 denotes a radiated electric field from the magnetic current that appears on the main aperture plane, numeral 306 denotes a radiated electric field from the magnetic current that appears on the rear aperture plane, and numeral 307 denotes a distant combined electric field.

As shown in FIG. 3, when the length of the aperture waveguide is shorter than ¼ of the intra-tube wavelength, the aperture waveguide is no longer resonant in the tube axis direction for the aforementioned reason. Therefore, as shown in FIG. 3, the intra-tube electric field 302 that appears on the main aperture plane 107 and the intra-tube electric field 304 that appears on the rear aperture plane 105 are in phases, and both of the fields have a direction from the metallic plate 101 to the copper foil 103 of the printed circuit board 102. Furthermore, the magnetic currents 301 and 303 on the respective aperture planes, which are generated from the electric fields 302 and 304 appearing on the respective aperture planes are in phases but have opposing directions. Consequently, in a distant combined electric field 307 that is obtained by combining electric fields 305 and 306 radiated from magnetic currents 301 and 303, which appear on the respective aperture planes at a distance, components of the radiated electric fields 305 and 306 cancel each other, whereby the radiation efficiency is greatly reduced. Here, even when the length of the aperture waveguide is shorter than ¼ of the intra-tube wavelength, the aperture waveguide can resonate widthwise when the widthwise length is ½ wavelength of the used frequency and both apertures 107 and 105 of the aperture waveguide are opened. However, also in this case, since the magnetic currents 301 and 303 that appear on the both aperture planes are in the same phases and opposite to each other as described above, the components of the radiated electric fields 305 and 306 cancel each other, whereby the radiation is greatly suppressed and thus the radiation efficiency remains low.

Then, in the antenna 100 according to the first embodiment, the insulating magnetic element 106 is loaded in the waveguide 104 as shown in FIG. 2, so as to block the rear aperture plane 105 which is selected from the aperture planes 107 and 105 of the waveguide 104. Here, the insulating magnetic element 106 internally has a magnetic dipole, and the magnetic dipole follows an external magnetic field, thereby changing its orientation toward a direction of reducing the internal magnetic field, as well as concentrating the magnetic currents toward the inside to suppress a leakage of the magnetic currents to outside the waveguide, thereby suppressing the magnetic currents which contribute the radiation.

When the insulating magnetic substance 106 is loaded in the above-mentioned manner, the magnetic current 303 that contributes the radiation appearing on the rear aperture plane 105 is suppressed by the insulating magnetic element 106, whereby the electric field 306 radiated from the magnetic current 303 that appears on the rear aperture plane 105 are suppressed, and consequently, the distant combined electric field 307 that is obtained by combining the radiated electric fields 305 and 306 from the magnetic currents appearing on the aperture planes 107 and 105 at a distance can achieve a high radiation efficiency.

As the insulating magnetic element 106, it is possible to utilize a common ferrite or the like having a relative permeability of 10 or higher. However, when the permittivity of the ferrite or the like is not small, the effect of suppressing the magnetic current which contributes the radiation is reduced because of an electric field concentration by the dielectric effect or an increase of the magnetic currents by the concentrated electric field. In such cases, it is possible to avoid the reduction of the magnetic current suppressing effect by using, as the insulating magnetic element 106, an anisotropic permittivity material which has a smaller permittivity in a direction 117 that is perpendicular to the surface of the printed circuit board 102, as compared to the permittivity in a direction 116 that is parallel to the surface of the printed circuit board 102.

In addition, the insulating magnetic element 106 having an anisotropic permittivity, which has a smaller permittivity in the direction perpendicular to the surface of the printed circuit board 102 as compared to the permittivity in the direction parallel to the surface of the printed circuit board 102, can be obtained by laminating layers of a magnetic material 118 and a dielectric material 119 having a permittivity which is smaller than that of the magnetic material 118 in the direction parallel to the surface of the printed circuit board 102, as shown in FIG. 2.

Further, when the relative permeability of the insulating magnetic substance 106 may become several hundreds or higher, the insulating magnetic element 106 has almost no magnetic field therein. Consequently, there is no magnetic field components in the direction of contacting the material surface on the surface of the insulating magnetic element 106, whereby there are only magnetic field components in the direction that is perpendicular to the material surface (which is referred to as a magnetic wall effect). Accordingly, since electromagnetic wave energy passing through the insulating magnetic substance 106 will disappear, only the magnetic current 302 that appears on the main aperture plane 107 is generated in the waveguide 104, whereby the radiated electric field components on the both aperture planes do not cancel each other. Consequently, the distant combined electric field 307 can achieve a higher radiation efficiency.

Further, when the above-mentioned aperture waveguide antenna is used for receiving the digital television broadcasts, it is necessary to enlarge the aperture area of the aperture waveguide antenna to increase the receiving band that can be received by the antenna, because the receiving band of the digital television broadcasts per channel is wide and larger than 6 MHz.

When the height of the waveguide 104 is increased, it is possible to easily enlarge the aperture area of the waveguide 104. However, when the aperture area is enlarged in this manner, the thickness of the waveguide 104 is increased, and when the antenna having a larger thickness is installed or mounted on the slim digital television, the antenna part juts out of the slim digital television receiver, which greatly damages the feature (slimness) of the receiver.

Thus, in the antenna 100 according to the first embodiment, the main aperture plane 107 of the waveguide 104 is subjected to the beveling 108 as shown in FIG. 1, to enlarge the aperture area of the main aperture plane 107 with keeping the waveguide 104 of the antenna 100 slim. Thus, the antenna can receive digital television broadcasts over a wide receiving band in which the receiving band per channel is 6 MHz or larger, and can be attached or installed to a slim television receiver without greatly damaging the feature (the slimness).

Next, the operation of the digital television broadcast receiving antenna 100 according to the first embodiment, which tunes for a wide band extending from 470 MHz to 710 MHz that is expected to be allocated to the digital television broadcasting especially in Japan, using a tuning element having the same reactance change range as in the prior art, will be described with reference to FIGS. 4 and 5.

Figure 4:
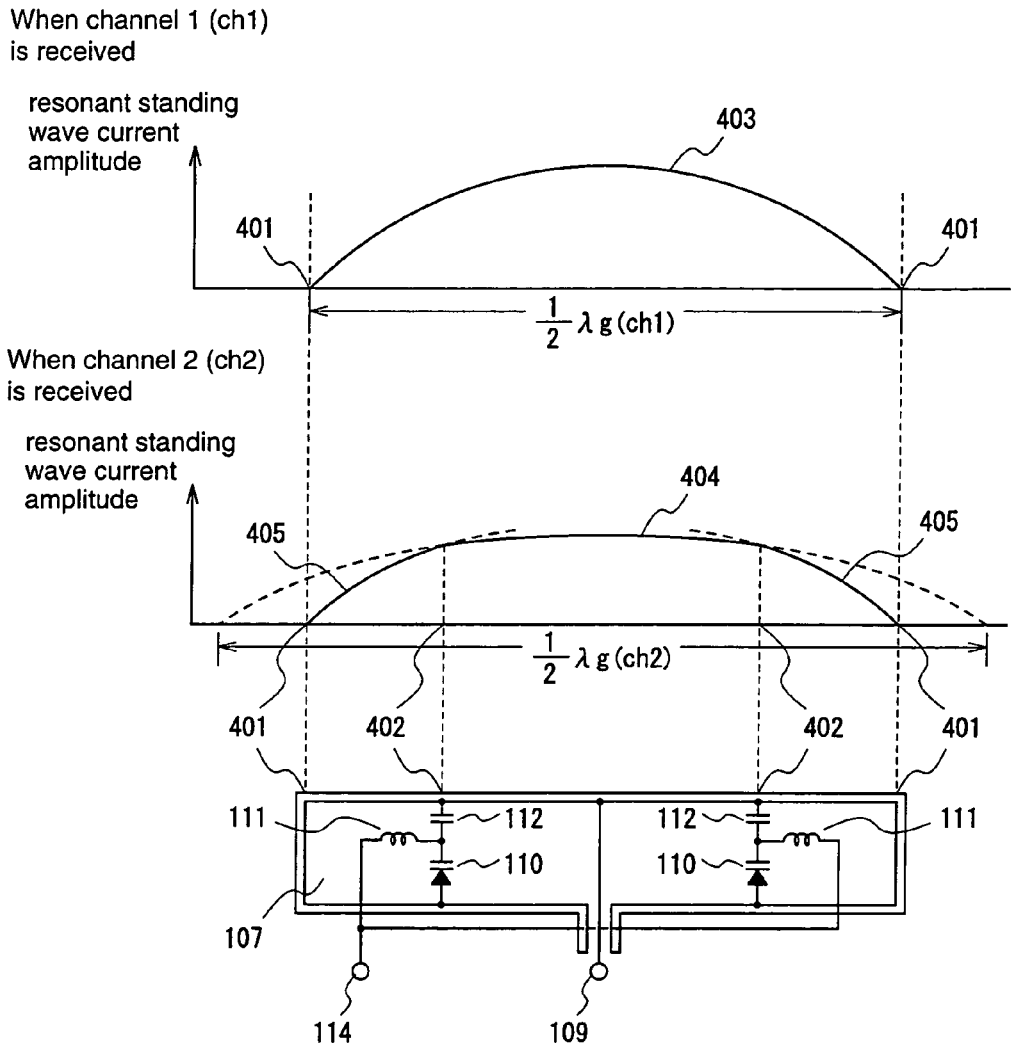
FIG. 4 is a diagram schematically showing currents on a main aperture plane of the digital television broadcast receiving antenna according to the first embodiment.

FIG. 4 is a diagram showing an amplitude of a resonant standing wave current that resonates in widthwise of the waveguide on the main aperture plane of the digital television broadcast receiving antenna according to the first embodiment. Numeral 401 denotes a metallic side wall of the waveguide 104, numeral 402 denotes a loading point of the electronic tuning element 110, numeral 403 denotes a resonant current of Channel 1 (ch1), which flows in a direction transverse to the main aperture plane, numeral 404 denotes a resonant current of Channel 2 (ch2) at the center part of the aperture, which flows in a direction transverse to the main aperture plane, and numeral 405 denotes a resonant current of Channel 2 (ch2) at the end part of the aperture, which flows in a direction transverse to the main aperture plane. FIG. 5 is a diagram showing the locus of a reflection coefficient in the Smith Chart on the main aperture plane of the digital television broadcast receiving antenna according to the first embodiment. It is assumed here that (the frequency of Channel 1)>(the frequency of Channel 2).

As shown in FIG. 4, at two electronic tuning element loading points 402 on the main aperture plane 107 of the aperture waveguide 104, an electronic tuning element 110 and a RF bypass capacitor 112 are connected, respectively. Further, the two electronic tuning element loading points 402 are connected to a tuning control voltage terminal 114 via RF choke coils 111.

As described above, in the antenna 100 according to the first embodiment, since the length of the waveguide 104 is shorter than ¼ of the intra-tube wavelength, there is no resonance in the tube axis direction. As the rear aperture plane 105 is in an open state where the insulating magnetic element 106 is loaded, the antenna resonates widthwise of the waveguide 104.

It is assumed that this antenna 100 receives digital broadcasts of Channel 1 (ch1) and Channel 2 (ch2). Initially, when Channel 1 (ch1) is to be received, since ½ of the wavelength of Channel 1 (ch1) (½λg) is the same as the width of the aperture of the waveguide 104 as shown in solid lines in upper graph of FIG. 4, the resonant current 403 of the aperture waveguide antenna 100 can resonate at the frequency of Channel 1 (ch1). On the other hand, when the digital broadcast of Channel 2 (ch2) is to be received, since ½ of the wavelength of Channel 2 (ch2) (½λg) and the width of the aperture of the waveguide 104 are different from each other as shown in dashed lines in lower graph of FIG. 4, the resonant current 404 of the aperture waveguide antenna 100 cannot resonate at the frequency of Channel 2 (ch2) as it is. Thus, in this aperture waveguide antenna 100, two electronic tuning elements 100 are loaded, and a preset voltage corresponding to the respective channel to be received (Channel 2 in this case) is applied to the tuning control voltage terminal 114 for the electronic tuning element 110, thereby to shift the phase of the resonant current stepwise at the two electronic tuning element loading points 402 as shown in solid lines in the lower graph of FIG. 4. By doing so, the resonant current of the aperture waveguide antenna 100 can resonate at the frequency (Channel 2), which is different in size from the waveguide 104.

Certainly, it goes without saying that the aperture waveguide antenna 100 can be resonated over a wider frequency range, i.e., the antenna 100 is allowed to have a wider tuning frequency range, as the step amount in phases which is variable at the two electronic tuning element loading points 402 provided in the waveguide 104 is larger. However, even when tuning elements having the same reactance are used as the electronic tuning elements 110, there are combinations of places of the two electronic tuning element loading points 402, in which the tuning frequency range can be enlarged more effectively.

Usually, it is possible to explain such combinations of the places by a transmission theory, while when two identical reactance elements are loaded on a transmission line, both ends of which are short-circuited and which resonates at a ½-wavelength (which corresponds to a current path which flows in the lateral direction on the main aperture plane 107 of the waveguide 104 in this first embodiment) between the line and a ground conductor (which corresponds to upper and lower metallic plates of the main aperture in the waveguide 104 in this first embodiment), it is possible to obtain larger resonant frequency variations when each of the reactance elements is loaded at a position within ¼ of a wavelength of a used frequency from the respective short-circuited surface (the respective metallic side wall of the waveguide 104 in this first embodiment), with relative to a case where both of the two elements are loaded within a ¼ wavelength from one of the short-circuited surfaces.

Figure 5:
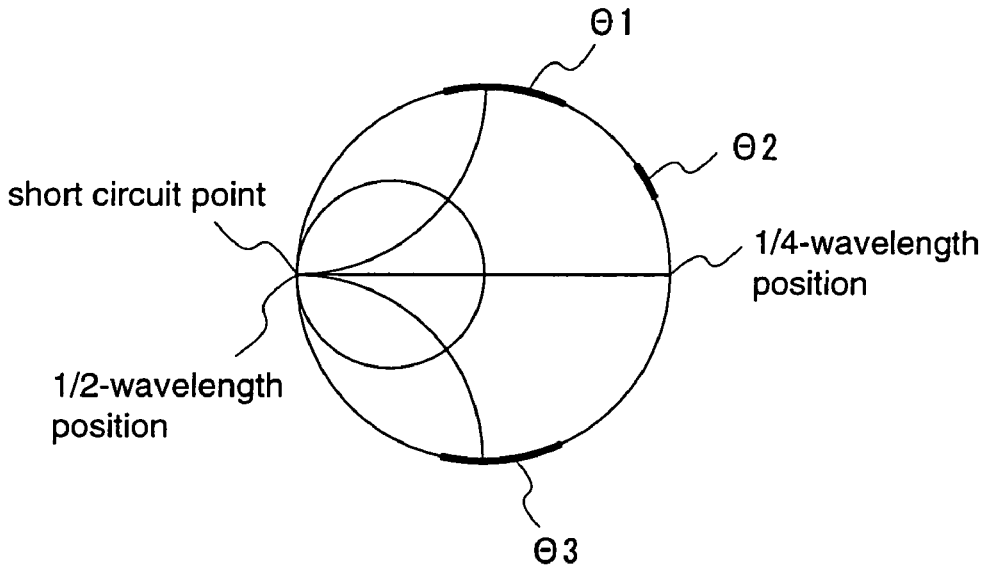
FIG. 5 is a diagram showing a reflection coefficient locus in the Smith Chart on the main aperture plane of the digital television broadcast receiving antenna according to the first embodiment.

This effect can be recognized from the fact that, as shown in the reflection coefficient locus on the Smith chart of FIG. 5, the maximum total value of phase rotation of the reflection coefficients due to two reactive elements becomes larger in a case where two identical reactive elements are loaded at a position 0~¼ wavelength apart from the short circuit point and at a position ¼~½ wavelength apart from the short circuit point, respectively, (corresponding to a combination of Θ1 and Θ3 in FIG. 5) than in a case where both of two identical reactive elements are loaded at positions 0~¼ wavelength apart from the short circuit point (corresponding to a combination of Θ1 and Θ2 in FIG. 5).

As described above, according to the first embodiment, the insulating magnetic element 106 is provided within the waveguide 104 so as to block the rear aperture plane 105 selected from the pair of aperture planes 107 and 105 of the waveguide. The main aperture plane 107 is subjected to the beveling 108, thereby enlarging the aperture area. Therefore, even when the length of the waveguide 104 is made shorter than ¼ wavelength (i.e., intra-tube wavelength) to lower the cost of the antenna, it is possible to provide a low-cost antenna which can realize a high radiation efficiency, and can be attached to or installed in a slim television receiver, without greatly deteriorating the feature (slimness) of the receiver. In addition, as the electronic tuning elements 110 for changing the resonance frequency of the aperture waveguide antenna 100 are provided in the waveguide 104 on both sides with respect to the center of the main aperture plane, it is possible to realize a digital television broadcast receiving antenna having a wider tuning frequency range even in cases of employing general-purpose electronic tuning elements as in the prior art.

In this first embodiment, the description has been given of the case where the antenna 100 receives the digital television broadcasts, while it is also possible to apply this antenna to a mobile communication device so long as this communication device is a device that utilizes horizontal polarization even when the conventional television broadcast band is utilized for purposes other than the mobile communication by reviewing the effective use of radio waves because of future frequency realignment.

Further, it is also possible to change the receiving band by dividing the waveguide 104 of the antenna 100 using a RF switch, whereby the antenna can be applied also to a device that needs tuning of a further wider frequency band.

Embodiment 2

A digital television broadcast receiver according to a second embodiment of the present invention will now be described with reference to FIGS. 6 and 7.

Initially, a structure of the digital television broadcast receiver according to the second embodiment will be described with reference to FIG. 6. FIG. 6 is a diagram showing the digital television broadcast receiver according to the second embodiment, when viewed from the back.

Figure 6:
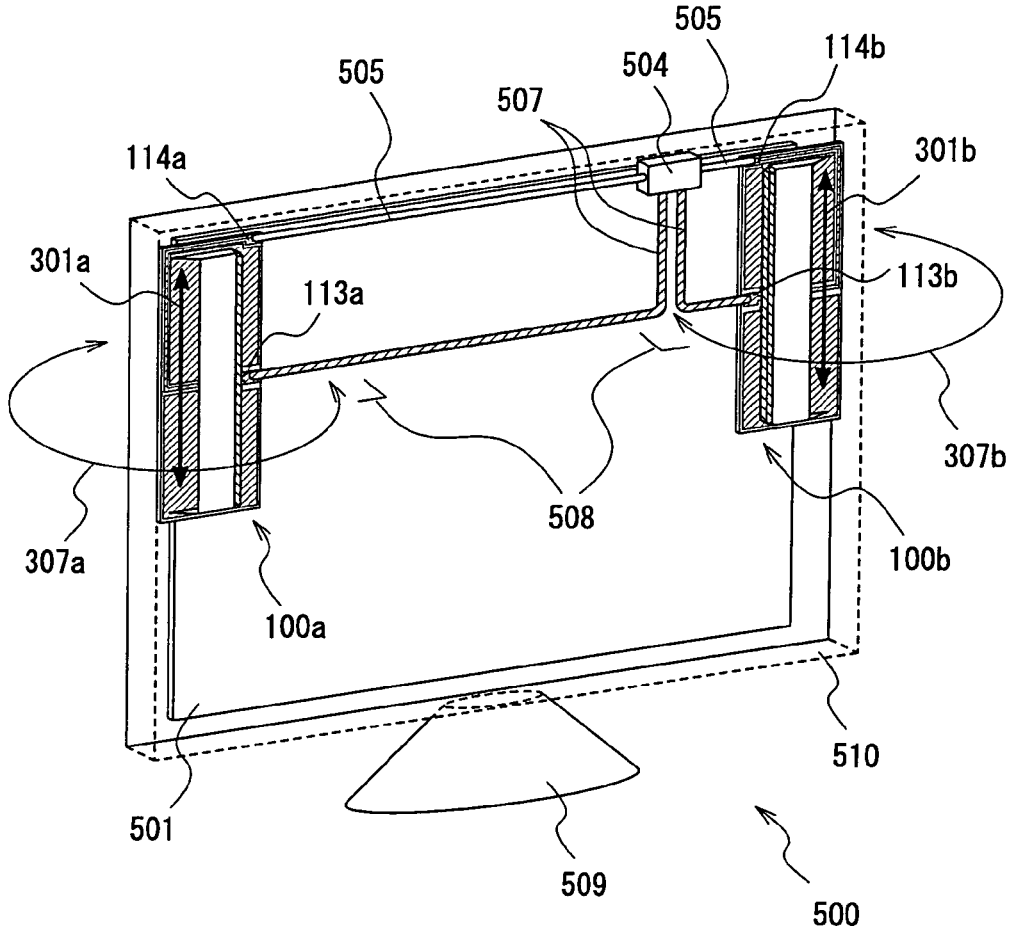
FIG. 6 is a diagram illustrating a digital television broadcast receiver according to a second embodiment of the present invention.

In FIG. 6, a digital television broadcast receiver 500 having a stand 509 according to the second embodiment includes a display 501 in a case 510. Here, by exclusively using as the display 501, various types of slim display devices such as a plasma display, a liquid crystal display, an electroluminescence display, or a field emission display, especially a surface-conduction electron-emitter display as an example of the field emission display, the digital television broadcast receiver 500 having a slim shape is realized.

Further, in the digital television broadcast receiver 500, electronically tunable aperture waveguide antennas 100*a* and 100*b* as described in the first embodiment are included so that magnetic currents 301*a* and 301*b* which are induced on their respective main aperture planes are located on both side ends of the digital television broadcast receiver 500. Feeding terminals 113*a* and 113*b* of the respective aperture waveguide antennas 100*a* and 100*b* and a phase synthesizer 504 are connected via RF cables, and further tuning control terminals 114*a* and 114*b* of the antennas 100*a* and 100*b* and the phase synthesizer 504 are connected via tuning control lines 505.

Since the receiving band of the aperture waveguide antenna is usually narrow, it is impossible to receive the digital television broadcasts in a wide frequency range, for example, extending from 470 MHz to 710 MHz which is expected in Japan, by itself. However, in the receiver 500 according to the second embodiment, by using the electronically tunable aperture waveguide antennas 100 that have been described in the first embodiment and tuning these antennas for a receiving channel at the time of receiving, the receiver 500 can practically receive the digital television broadcast over a wide frequency band range (470 MHz to 710 MHz).

In addition, in the aperture waveguide antennas 100*a* and 100*b*, distant radiated fields 307*a* and 307*b* which are electric fields that are radiated due to the magnetic current 301*a* and 301*b* induced on the main aperture plane and are combined at a distance are generated as described in the first embodiment. These distant radiated fields 307*a* and 307*b* are vertically entered as indicated by an incident angle 508 with respect to a surface of the display 501 which is mainly a metal body, as shown in FIG. 6. Thus, since the polarization of the radiated electric fields 307*a* and 307*b* is the horizontal polarization as is suitably used in the digital television broadcasting, the receiver 500 can receive the digital television broadcast with efficiency.

Further, since the incident angle 508 of the radiated electric fields 307*a* and 307*b* has a similar shape to the original electric field distribution corresponding to the magnetic currents 301*a* and 301*b*, regardless of the presence or absence of the display 501, the directional characteristics of the aperture waveguide antennas 100*a* and 100*b* will not be deteriorated. Therefore, characteristics of having almost no horizontal directivity while exhibiting the horizontal polarization, which are advantages of the magnetic current inducing type antenna, are kept. Thus, it is possible to integrate or mount the aperture waveguide antennas 100*a* and 100*b* of the magnetic current inducing type in the slim receiver 500 according to the second embodiment, without deteriorating the radiation efficiency.

Further, since the aperture waveguide antennas 100*a* and 100*b* which are integrated or mounted on the receiver 500 have characteristics that their radiation efficiency will not be affected unless they are placed near the main aperture planes of the waveguide, even when the metal part of the display 501 or the like is located around the antenna, these antennas can be integrated in the case 510 of the digital television broadcast receiver 500 without producing a jut, as shown in FIG. 6. Thus, a digital television broadcast receiver with built-in antenna, in which the antenna part is not jutting, can be realized.

Further, in the digital television broadcast receiver 500 according to the second embodiment, the RF cables 507 and the phase synthesizer 504 are provided as described above, and digital television broadcast waves which have been received by two aperture waveguide antennas 100*a* and 100*b* are subjected to phase synthesis diversity reception, and then captured by a receiving circuit (not shown) in the receiver 500. The receiving circuit, a power supply circuit, and the like which are mounted on the receiver 500 are not shown in FIG. 6, while these are the same as those commonly used in other digital television broadcast receivers.

Here, the operation of the digital television broadcast receiver 500 according to the second embodiment, for changing the antenna directivity to a broadcast wave incoming direction by the electronic control, will be described with reference to FIG. 7.

Figure 7:
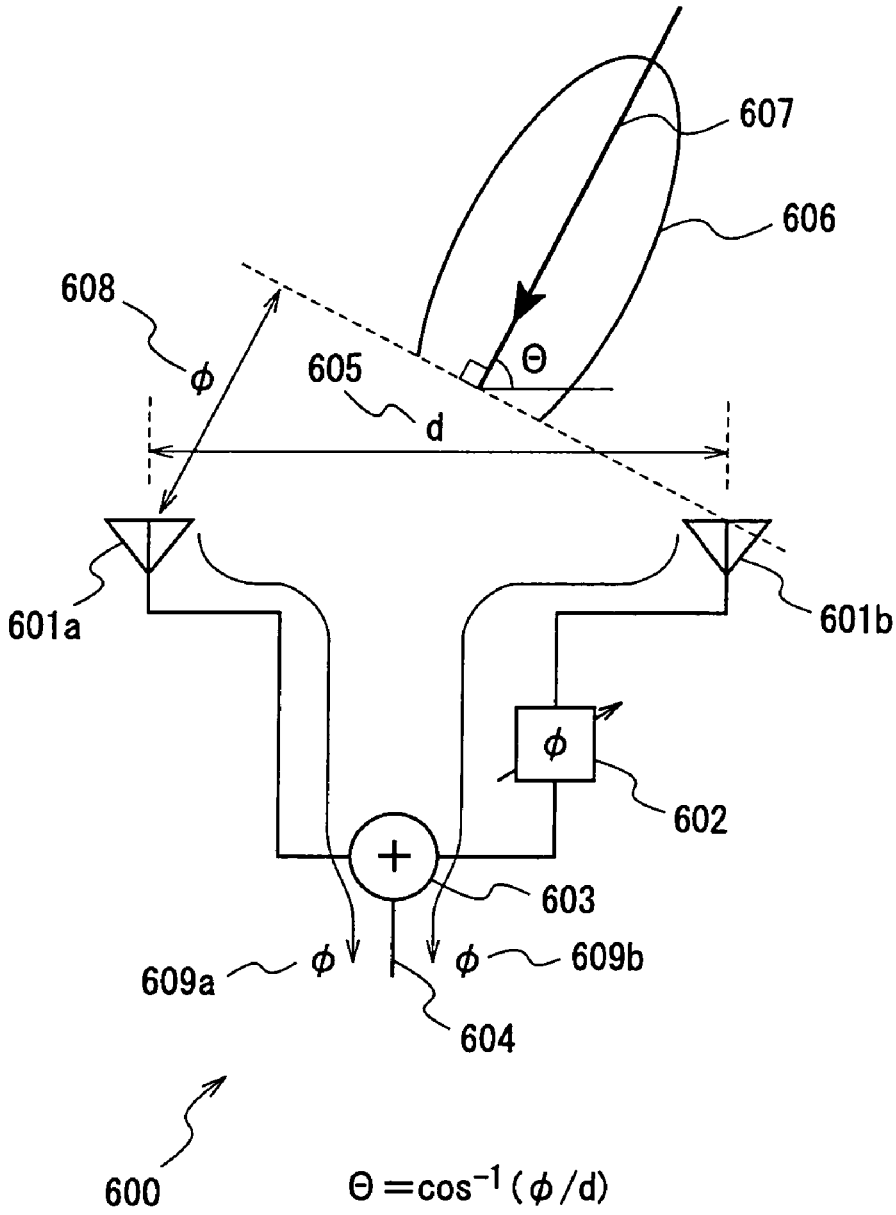
FIG. 7 is a diagram schematically showing a phase synthesizing diversity operation according to the second embodiment.

FIG. 7 is a diagram schematically showing a phase synthesis diversity operation in the digital television broadcast receiver according to the second embodiment. Numeral 600 denotes a phase synthesis diversity antenna, numerals 601*a* and 601*b* denote unit antenna elements, numeral 602 denotes a variable phase shifter, numeral 603 denotes a synthesizer, numeral 604 denotes a antenna input line, numeral 605 denotes a distance between the antenna elements, numeral 606 denotes a synthesized main beam, numeral 607 denotes radio waves coming from the main beam direction, numeral 608 denotes an amount of shift in space, and numerals 609*a* and 609*b* denote amounts of shift of signals from when the signals are received by the unit antenna elements 601*a* and 601*b* to when these signals reach the antenna input line 604, respectively. The unit antenna elements 601*a* and 601*b* in FIG. 7 correspond to the aperture waveguide antennas 100*a* and 100*b* in FIG. 6, the variable phase shifter 602 and the synthesizer 603 in FIG. 7 correspond to the phase synthesizer 504 in FIG. 6, and the antenna input line 604 which outputs a phase-synthesized receiving signal in FIG. 7 corresponds to a connecting line (not shown) for connecting the phase synthesizer 504 and a receiving circuit (not shown) in the receiver 500 in FIG. 6.

The variable phase shifter 602 can be easily realized, for example, by using a method of switching lines that have different lengths using a PIN diode, or using a method of shifting a phase using Varactor diodes which are connected in series on a line as well as eliminating a matching deviation which is caused by the phase shift by using a series resonant circuit of a coil and a Varactor diode which are connected in parallel on the line.

In this case, the shift amounts on the lines from the unit antenna elements 601*a* and 601*b* to the antenna input line 604 are neglected because they are not necessary in the description of the operation of the phase synthesis diversity.

When the radio waves 607 coming from the main beam direction reach the digital television broadcast receiver 500 according to the second embodiment, which is constructed as described above, a receiving signal that is received by the unit antenna element 601*a* arrives at the synthesizer 603 according to the shift amount $\phi$ corresponding to the shift amount 608 in space.

On the other hand, the phase of the receiving signal that has been received by the unit antenna element 601*b* is not shifted in spaces, while it reaches the synthesizer 603 according to the shift amount $\phi$ by the variable phase shifter 602.

Therefore, as these receiving signals are combined in the same phases, a strong receiving signal is outputted to the antenna input line 604. That is, the digital television broadcast receiver according to the second embodiment has a synthesized main beam 606 in a direction shown by 607.

Here, since the direction $\Theta$ of the synthesized main beam 606 is expressed by:

$$\Theta=\cos^{-1}(\phi/d)$$

as shown in the figure, it is possible to electronically change the direction $\Theta$ of the synthesized main beam 606 by electronically changing the shift amount $\phi$ in the variable phase shifter 602.

As described above, according to the second embodiment, since two aperture waveguide antennas 100*a* and 100*b* and the phase synthesizer 504 are provided, it is possible to realize a digital television broadcast receiver which can perform the phase synthesis diversity reception, thereby enabling to change the antenna directivity to the direction of incoming broadcast waves by the electronic control. Accordingly, it is possible to realize a slim digital television broadcast receiver that can provide digital television broadcasts in a free position indoors, without requiring an external antenna that is connected via a cable, or an indoor antenna that juts outside, or an external device that receives the broadcast waves and relay or retransmit the waves to the receiver.

In this second embodiment, as the digital television broadcast receiving antennas 100*a* and 100*b* which are integrated or mounted in the receiver 500, antennas in which a rear aperture plane of the waveguide 104 is not blocked by a metallic plate are employed. However, as already described in the first embodiment, when an insulating magnetic substance having a high magnetic permeability is used as the insulating magnetic element 106 that is provided in the waveguide 104, antennas in which the rear aperture plane of the waveguide 104 is blocked by a metallic plate can be employed as the digital television broadcast receiving antennas 100*a* and 100*b* because the magnetic current appearing on the rear aperture plane is sufficiently suppressed.

In addition, in this second embodiment, the digital television broadcast receiving antennas 100*a* and 100*b* are built in the digital television broadcast receiver 500, while the digital television broadcast receiving antennas 100*a* and 100*b* can be provided as separate components which are enclosed in a dedicated resin case and mounted on the rear surface of the receiver.

In this second embodiment, the magnetic current inducing type digital television broadcast receiving antennas 100*a* and 100*b* are provided on the side ends of the receiver 500, respectively. However, it goes without saying that two or more antennas 100*a* and 100*b* can be provided on both side ends of the receiver 500, respectively, in series to combine the power, thereby further enlarging the equivalent aperture area.

Further, in the first and second embodiments, the digital television broadcast receiving antenna 100 in which the electronic tuning element 110 and the biasing elements 111 and 112 are loaded in the waveguide 104 in exposed manners is shown, while it is needless to say that combination of the electric field in the waveguide 104 of the antenna 100 and circuits of a device on which the antenna 100 is mounted can be relieved by covering these elements with a metallic cover. Accordingly, an antenna that can provide a stable tuning operation can be realized.

Further, the second embodiment can be applied to all devices that receive the digital television broadcasts. For example, when a common projector which projects pictures on the front of the screen internally contains a digital television broadcast receiving function, it is possible to apply the second embodiment to such projector.

Further, since digital television broadcast receivers which project pictures from the back of the screen, (i.e., so-called rear projection type digital television broadcast receiver) have been increasingly slimmed, it is possible to apply the second embodiment to such receivers.

Further, this embodiment may be applied to a monitor of a personal computer, various types of cellular phones, or the like which has a digital television broadcast receiving function.

This second embodiment can be applied not only to the slim digital television broadcast receiver but also a digital television broadcast receiver using a CRT or the like, whereby it is possible to receive the digital television broadcasts by freely placing the receiver indoors.

Further, in this second embodiment, the receiver 500 which has only a common television receiving function for displaying only received broadcasts have been shown, while it is possible to employ a receiver that is provided with an optical disc drive or a hard disk drive, in addition to the display 501.

Further, this embodiment can be utilized for other purposes, such as for an external antenna of a set top box including an optical disc drive or a hard disk drive, which receives the digital television broadcasts.

Furthermore, the second embodiment can be applied not only to the digital television broadcast receiver but also to a receiver adapted to the current analog broadcasting or a receiver having a receiving function that is adapted to both of the digital television broadcasting and current analog broadcasting, and further to a receiver that has a recording function and a reproduction function.

The present invention is useful in realizing a slim digital television broadcast receiver which enables to provide digital television broadcasting in a free position indoors, without the need of an external antenna or an indoor antenna jutting outside, which is connected via a cable, and an external device for receiving broadcast waves and relaying or retransmitting the waves to the receiver, at low cost.

What is claimed is:

1. A broadcast receiving antenna of a magnetic-current inducing type comprising:

a waveguide having a pair of aperture planes, which are formed by a metallic plate and a copper foil on a printed circuit board;

an insulating magnetic element which is loaded in the waveguide so as to block one of said pair of aperture planes of the waveguide; and tuning elements for changing a resonance frequency of the waveguide, which are placed on opposed sides with respect to a center part of the other aperture plane of the waveguide.

2. The broadcast receiving antenna as defined in claim 1 wherein the insulating magnetic element has an anisotropic permittivity which is smaller in a direction perpendicular to the printed circuit board than in a direction parallel to the printed circuit board.

3. The broadcast receiving antenna as defined in claim 2 wherein the insulating magnetic element is formed by laminating layers of a magnetic material and a dielectric material which has a permittivity that is smaller than that of the magnetic material.

4. The broadcast receiving antenna as defined in claim 1 wherein the length of the waveguide is equal to or shorter than a quarter of an intra-tube wavelength.

5. The broadcast receiving antenna as defined in claim 1 wherein the tuning elements which are placed on opposed sides with respect to the center part of the other aperture plane are respectively located at a position within a quarter of a wavelength of a used frequency from metallic side walls of the waveguide.

6. A television broadcast receiver for receiving television broadcasts, including one of a group consisting of a plasma display, a liquid crystal display, an electroluminescence display, and a field emission display, comprising:

two electronically tunable aperture waveguide antennas integrated into or mounted on said receiver so that magnetic currents induced on aperture parts of said antennas are located on respective side ends of said receiver, said aperture waveguide antennas being operable to be tuned to a receiving channel of the television broadcast while receiving, each of said aperture waveguide antennas comprising a magnetic current-inducing antenna including:

a waveguide having a pair of aperture planes formed by a metallic plate and a copper foil on a printed circuit board;

an insulating magnetic element arranged in said waveguide so as to block a first one of said pair of aperture planes of said waveguide; and tuning elements for changing a resonance frequency of said waveguide, said tuning elements being arranged on opposed sides with respect to a center part of a second one of said pair of aperture planes of said waveguide.

7. The television broadcast receiver of claim 6, wherein said insulating magnetic element has an anisotropic permittivity which is smaller in a direction perpendicular to said printed circuit board than in a direction parallel to said printed circuit board.

8. The television broadcast receiver of claim 7, wherein said insulating magnetic element is formed by laminating layers of a magnetic material and a dielectric material which has a smaller permittivity than that of said magnetic material.

9. The television broadcast receiver of claim 6, wherein said two electronically tunable aperture waveguide antennas are operable to perform phase synthesis diversity reception.

* * * * *